US011208304B2

(12) United States Patent
Ceresoli et al.

(10) Patent No.: US 11,208,304 B2
(45) Date of Patent: Dec. 28, 2021

(54) LIMITED ROTATION SLEWING RING CRANE

(71) Applicant: FASSI GRU S.p.A., Albino (IT)

(72) Inventors: Rossano Ceresoli, Ranica (IT); Piantoni Giorgio, Vertova (IT)

(73) Assignee: FASSI GRU S.P.A., Albino (IT)

( * ) Notice: Subject to any disclaimer, the term of this patent is extended or adjusted under 35 U.S.C. 154(b) by 3 days.

(21) Appl. No.: 16/985,300

(22) Filed: Aug. 5, 2020

(65) Prior Publication Data

US 2021/0061625 A1 Mar. 4, 2021

(30) Foreign Application Priority Data

Sep. 2, 2019 (IT) ..... 102019000015388

(51) Int. Cl.
*B66C 23/94* (2006.01)
*B66C 23/16* (2006.01)

(52) U.S. Cl.
CPC ..... *B66C 23/94* (2013.01); *B66C 23/163* (2013.01)

(58) Field of Classification Search
CPC ..... B66C 23/16; B66C 23/163; B66C 23/62; B66C 23/84; B66C 23/86; B66C 23/94; B66C 13/46
See application file for complete search history.

(56) References Cited

U.S. PATENT DOCUMENTS

2012/0117810 A1* 5/2012 Schroder ..... B66C 23/84 33/1 PT
2018/0118525 A1* 5/2018 Ceresoli ..... B66C 13/46

FOREIGN PATENT DOCUMENTS

JP H0542295 U * 6/1993 ..... B66C 23/94
JP H0920500 A * 1/1997 ..... B66C 23/90
JP 6180962 B2 * 8/2017 ..... B66C 23/94

OTHER PUBLICATIONS

JPH 0920500A Machine Translation (Year: 1997).*
JP 6180962B2 Machine translation (Year: 2017).*
JPH 0542295U Machine Translation (Year: 1993).*

* cited by examiner

*Primary Examiner* — Michael R Mansen
*Assistant Examiner* — Juan J Campos, Jr.
(74) *Attorney, Agent, or Firm* — Mark Malek; Widerman Malek, PL

(57) ABSTRACT

A limited rotation slewing ring crane may include a pedestal, a column rotatively coupled, about a first rotation axis, to the pedestal by a slewing ring rotative coupling, and stops for limiting the relative rotation of the column with respect to the pedestal. The crane may also include a rotative sensor adapted to measure a rotation angle of the column with respect to the pedestal. The rotation sensor may include a tubular body axially extending from the base of the column, a stationary body connected to the pedestal and a wheel. A second rotation axis of the wheel may be offset with respect to a first rotation axis of the column with respect to the pedestal.

11 Claims, 4 Drawing Sheets

LIMITED ROTATION SLEWING RING CRANE

RELATED APPLICATIONS

This application is a U.S. utility patent application and claims benefit to Italian Application No. 102019000015388 on Sep. 2, 2019 and titled LIMITED ROTATION SLEWING RING CRANE. The content of this application is incorporated herein by reference.

TECHNICAL FIELD OF THE INVENTION

The present invention refers to a limited rotation slewing ring crane, particularly a limited rotation slewing ring crane provided with a sensor of the rotation of the column with respect to the pedestal.

PRIOR ART

Slewing ring cranes are a particular type of loading cranes, which differ from the rack cranes by the way the column and pedestal are rotatively coupled to each other. Specifically, the slewing ring cranes comprise a bearing coupling (the slewing ring) for providing such relative rotation.

The slewing ring cranes, in comparison with the rack cranes, although are structurally complex, provide more power to the rotation.

In turn, the slewing ring cranes are divided in unlimited rotation slewing ring cranes and limited rotation slewing ring cranes. The first ones are characterized by the fact that the column rotation with respect to the pedestal is unlimited, while the second ones are provided with stop elements limiting the rotation arc of the column with respect to the pedestal. The unlimited slewing ring cranes are structurally more complex than the limited rotation slewing ring cranes because the former require the presence of electric and hydraulic joints at the rotative coupling between the column and pedestal which are arranged in order to prevent the hydraulic pipes and electric cables from twisting due to the potentially unlimited rotations of the column with respect to the pedestal. Generally, the limited rotation slewing ring cranes do not have this problem, consequently they do not require hydraulic and electric joints.

Loading cranes are provided with multiple sensors, which are required for supplying a measurement of magnitudes representative of the state of the crane, and consequently, ultimately, for enabling an effective operation. One of the required sensors is the rotation sensor apt to measure the rotations of the column with respect to the pedestal.

In case of an unlimited rotation slewing ring crane, such sensor, typically a rotative encoder, is associated to the beforehand cited electric joint. However, although this solution is structurally complex and expensive, cannot be advantageously applied to the limited rotation slewing ring cranes since these latter do not require an electric and hydraulic joint.

Cranes of know type are described in the documents JP H09 20500 A, JP H05 42295 U and JP 2015 160676 A.

SUMMARY OF THE INVENTION

Therefore, an object of the present invention is to provide a limited rotation slewing ring crane equipped with a sensor of the rotation of the column with respect to the pedestal which is a structurally simplified and less expensive alternative to the solution provided in the unlimited slewing ring cranes.

This and other objects are obtained by a limited slewing ring crane comprising a pedestal, a column rotatively coupled, about a first rotation axis, to the pedestal by a slewing ring rotative coupling, and means for limiting the relative rotation of the column with respect to the pedestal, further comprising a rotative sensor adapted to measure a rotation angle of the column with respect to the pedestal, wherein said rotation sensor comprises:

- a tubular body axially extending from the base of the column and rotatively integral with the same;
- a stationary body connected to the pedestal and a wheel, rotatable with respect to the stationary body about a second rotation axis, which is meshed by the tubular body, wherein the second rotation axis of the wheel with respect to the stationary body is offset with respect to the first rotation axis of the column with respect to the pedestal;
- means for sensing the angular position of the wheel with respect to the stationary body.

Dependent claims define possible advantageous embodiments of the invention.

BRIEF DESCRIPTION OF THE FIGURES

In order to better understand the invention and appreciate the advantages, some exemplifying non-limiting embodiments thereof will be described in the following with reference to the attached figures, wherein.

DETAILED DESCRIPTION OF THE INVENTION

Figure 1:
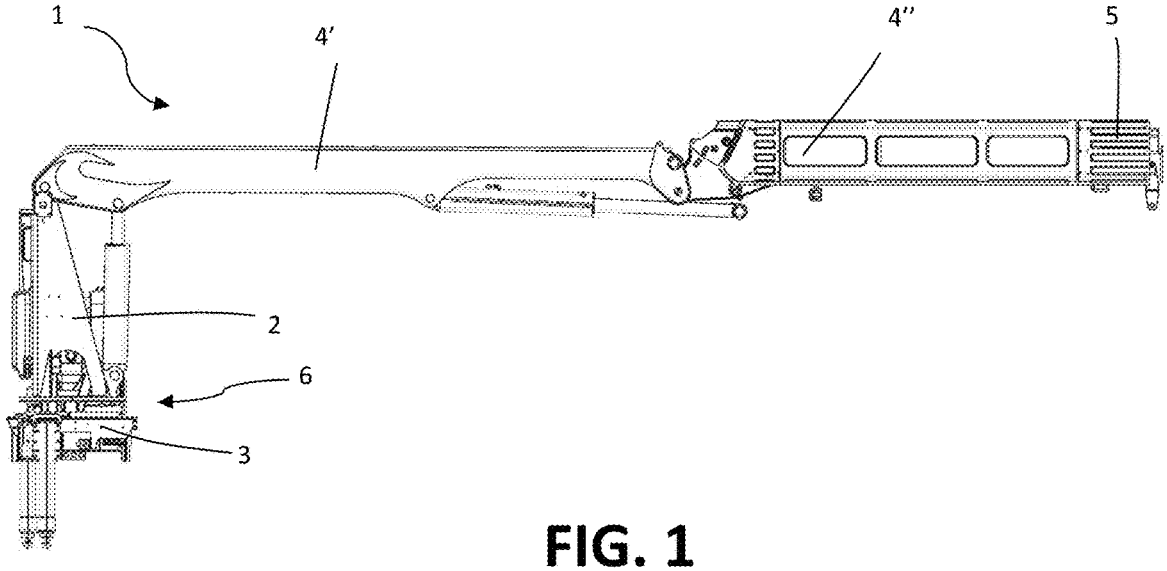
FIG. 1 is a side view of a limited rotation slewing ring crane according to an embodiment.
Figure 2:
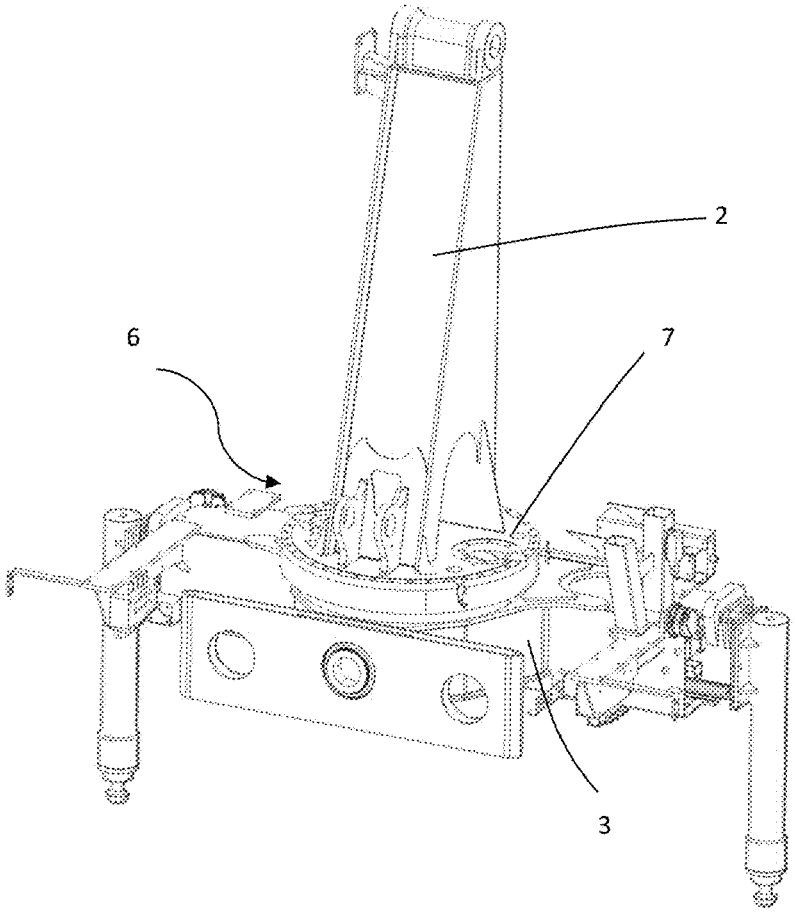
FIG. 2 is a perspective view of a detail of crane in FIG. 1.
Figure 3:
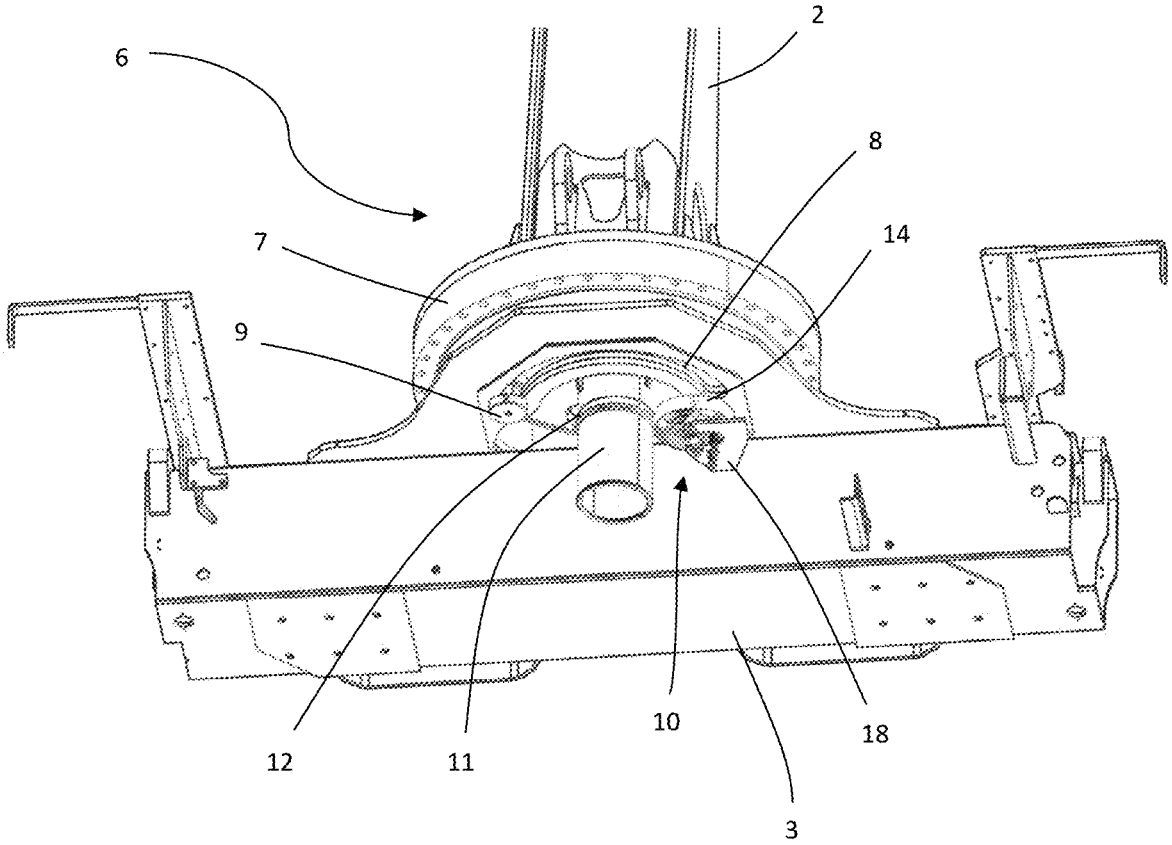
FIG. 3 is a perspective view of the lower side of the detail of crane in FIG. 2.

Referring to the attached FIG. 1, reference 1 generally indicates a limited rotation slewing ring crane.

The crane 1 comprises a column 2 rotating about a rotation axis with respect to a pedestal 3, and one or more arms 4', 4", eventually of the extendable type. The extendibility of the arms, if provided, is obtained by a plurality of extensions 5 translatingly movable from each other, operated by hydraulic actuators, in order to vary the axial extension of a corresponding arm. In the example of FIG. 1, only the second arm 4" is extendable by moving the extensions 5.

Referring now to Figures from 2 to 6, the base of the column 2 is rotatively coupled to the pedestal 3 by a rotative coupling 6 comprising a slewing ring 7. The term "slewing ring" means an axial bearing particularly adapted to operate at low rotation speeds and with high axial loads, comprising an inner crown and outer crown coupled by one or more crowns of balls or rolls such to enable the relative rotations. Moreover, it is observed that the term "base" of the column indicates the portion of the column 2 proximate to the pedestal 3, in other words the lower portion of the column 2, with reference to the normal conditions of use of crane 1.

The crane 1 comprises means for limiting the relative rotation of the column 2 with respect to the pedestal 3. For example, the rotative coupling 6 can comprise one or more mechanical stop elements capable of limiting the relative rotation of the column 2 with respect to the pedestal 3. According to an embodiment, such mechanical stop elements comprise a crescent-shaped slot 8, preferably made in the pedestal 3, and at least one pin 9, preferably associated to the column 2, parallel to and radially distanced from the rotation axis of this latter, sliding inside said slot 8. Constraining the pin 9 to slide inside the slot 8 limits the angular amplitude of the column 2 rotation with respect to the pedestal 3. According to an alternative embodiment, the column 2 rotation with respect to the pedestal 3 can be electronically limited, for example by shutting off the supply to the crane 2 if the column relative rotation preset limits 2 with respect to the pedestal 3 are exceeded.

The crane 1 comprises a rotative sensor 10 adapted to measure a rotation angle of the column 2 with respect to the pedestal 3, of which a description according to some possible embodiments of the invention will be provided. It is observed that such rotative sensor 10 can also be used for monitoring if the position of the column 2 falls inside preset rotation limits with respect to the pedestal if the mechanical stop elements are not provided.

Particularly, such rotative sensor 10 comprises a tubular body 11 placed at the base of the column 2 and axially protruding from the same preferably towards the inside of the pedestal 3 (in other words towards the ground, with reference to the normal conditions of use of the crane 1). The tubular body 11 is rotatively integral with the column 2. According to a possible embodiment, the tubular body 11 is made by a piece distinct from the column 2 and is fixedly connected to the latter. It is observed that the electric cables and hydraulic pipes (not shown in the figures) extend through the tubular shape of the tubular body 11 towards the crane arms.

The tubular body 11 comprises an auxiliary crown 12, concentric with it and rotatable about the same rotation axis integrally with the tubular body 11. According to an embodiment, such auxiliary crown 12 is made of a deformable material, wherein the term "deformable" does not mean a deformation of a limited amount, such as the one affecting a rigid material for example (such as a metal) subjected to a pressure, but a macroscopic deformation obtained by using a naturally deformable and yielding material. For example, such auxiliary crown 12 can be made of an elastomeric material, such as rubber.

According to a possible embodiment, the auxiliary crown 12 of wheel 14 of sensor 10 is removable from the wheel itself. For example, the auxiliary crown 12 can comprise a removable O-ring. Consequently, the deformable crown 12 can be simply substituted when the same is worn.

Moreover, the rotative sensor 10 comprises a stationary body 13 connected, by ways explained in the following, to the pedestal 3, and a wheel 14 rotatable with respect to the stationary body 13, which is meshed by the tubular body 11, particularly by the auxiliary crown 12 of the tubular body 11, so that a rotation of the column 2 matches a rotation of the wheel 14 of the sensor 10. The stationary body 13 and wheel 14 are positioned with respect to the pedestal 2 so that the wheel 14 rotation axis with respect to the stationary body 13 is offset, in other words does not overlap, with respect to the column 2 rotation axis with respect to the pedestal 3. Preferably, the wheel 14 rotation axis with respect to the stationary body 13 is parallel to the column 2 rotation axis with respect to the pedestal 3.

According to an embodiment, the wheel 14 comprises circumferentially placed raised elements 15, shaped as teeth developing along the axial direction of wheel 14, apt to deform the auxiliary crown 12 of tubular body 11 and therefore in order to ensure a high friction between this latter and wheel 14. As an alternative or in addition to the raised elements 15, wheel 14 can comprise a deformable circumferential crown (not shown in the figures), made of a deformable material having characteristics analogous to the ones described with reference to the possible deformable material by which the auxiliary crown 12 of tubular body 11 can be made, according to what was previously described. According to an embodiment, the deformable crown is removable from the wheel 14, so that can be substituted in case of wear and/or failure. The deformable crown can be positioned above the raised elements 15 in order to generally take a toothed shape.

It is observed wheel 14 and tubular body 11 can have different diameters from each other so that between them there is a transmission ratio different from 1, given by the ratio of the corresponding diameters.

In order to enable the rotations of wheel 14 with respect to the stationary body 13, wheel 14 preferably comprises a shaft 17 connected to the stationary body 13 by one or more bearings 30.

The sensor 10 comprises means 31 for sensing the angular position of the wheel 14 of the sensor with respect to the stationary body 13. Consequently, by measuring such angular position, it is possible to obtain, knowing the beforehand cited transmission ratio, the angular position of column 2 with respect to the pedestal 3.

According to a possible embodiment, the sensing means of sensor 10 comprise a magnet associated to the wheel 14 and a sensing probe associated to the stationary body 13, configured to sense the magnet angular position, and consequently the position of the wheel 14 of sensor 10, with respect to the stationary body 13 based on the magnetic field variations generated by the rotations themselves. Using a magnetic sensor prevents relatively rotating parts from contacting each other and therefore reduces wear. Advantageously, the sensor 10 comprises an output 32 for transmitting a signal representative of the performed angular measurement.

According to an embodiment, the stationary body 13 of the sensor is connected to the pedestal 3 so that it can perform oscillations, between two end positions, with respect to it, about an oscillation axis, preferably offset from the wheel 14 rotation axis with respect to the stationary body 13. Moreover, elastic means adapted to bias the stationary body 13 towards a position, between said oscillation end positions, are provided, so that the wheel 14 is biased against the tubular body 11. Such arrangement makes the sensor 10 capable of compensating deformations and/or oscillations of the column 2, which the tubular body 11 is connected to.

According to a possible embodiment, the pedestal 3 comprises a connecting plate 18 having a first hole 19 and a crescent-shaped slot 20. The stationary body 13 of sensor 10 is connected to the plate 18 by a first screw 21 crossing the first hole 19 of plate 18 and fixed in a first connecting seat 22 of the stationary body 13, and by a second screw 23 crossing the crescent-shaped opening 19 of the plate 18 and fixed in a second connecting seat 24 of the stationary body 13. Consequently, the stationary body 13 of sensor 10 can oscillate with respect to the plate 18 about the first screw 21 between two end positions set by the second screw 23 sliding between the opposite ends of the crescent-shaped opening 20. Preferably, the first seat 22 and second seat 24 are disposed in opposite positions with respect to the wheel 14 rotation axis with respect to the stationary body 13 and such that the oscillation axis of stationary body 13 with respect to the plate 18 is parallel to the wheel 14 rotation axis with respect to the stationary body 13.

Advantageously, the beforehand cited elastic means comprise a coil spring 25 fixed at a first end thereof by a third screw 26 in a third seat 27 of the stationary body 13 and fixed at a second end thereof by a fourth screw 28 in a fourth seat 29 of the connecting plate 18. Preferably, the third 27 and fourth connecting seats 29 are disposed on a side opposite with respect to the side where the wheel 14 meshes the tubular body 11. Preferably, the coil spring 25 is tensilely preloaded.

Figure 4:
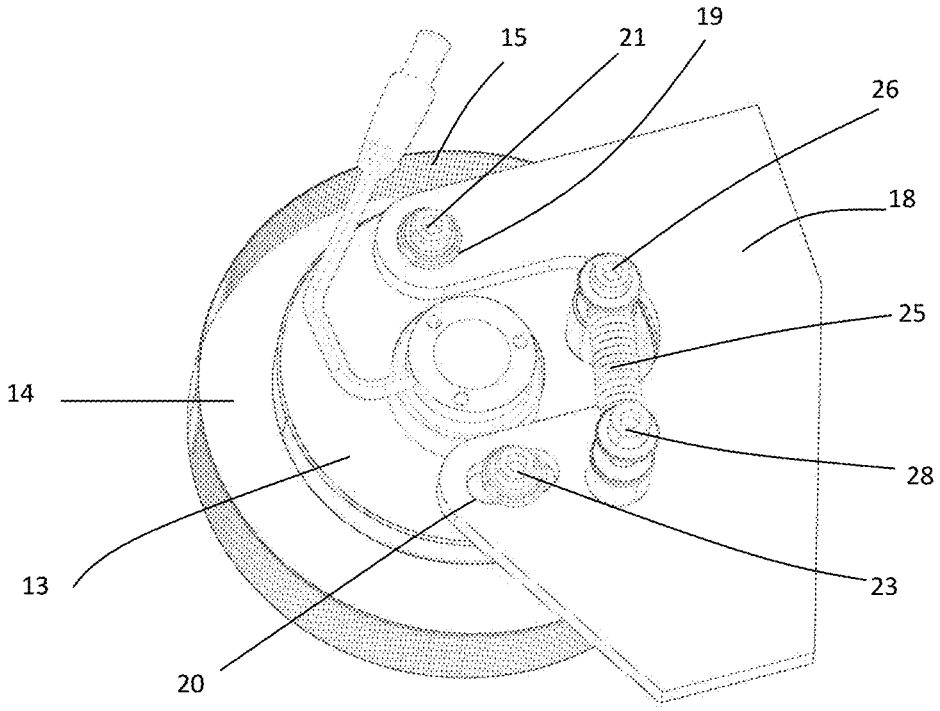
FIG. 4 is a perspective view of a detail of a crane sensor according to an embodiment.
Figure 5:
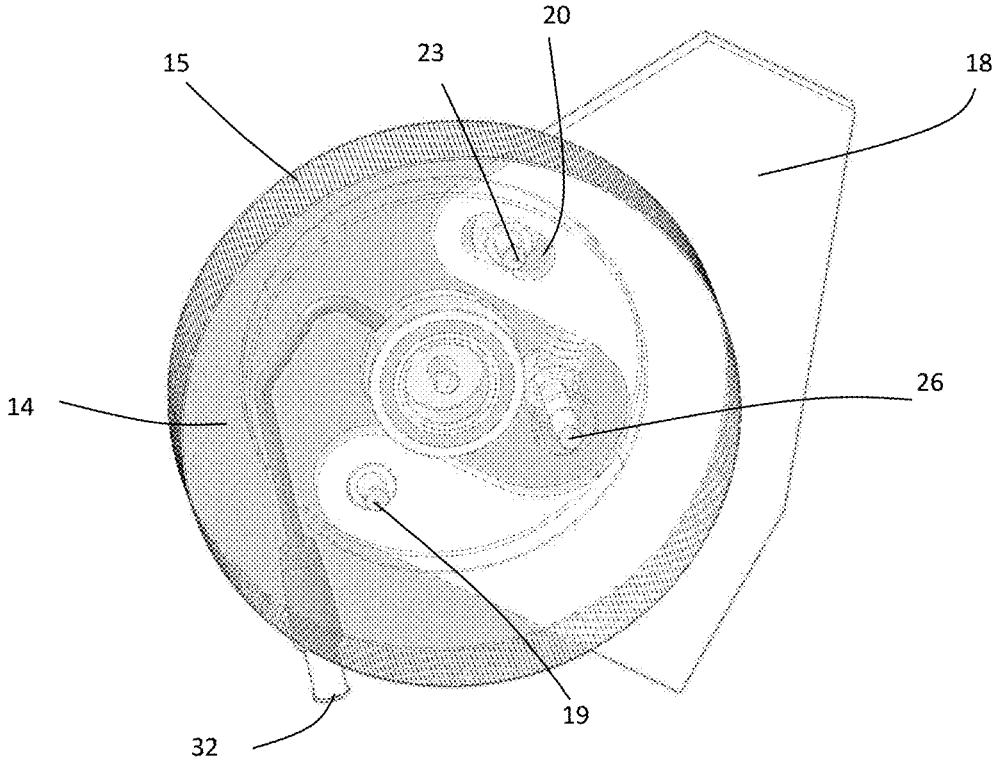
FIG. 5 is a partially phantom perspective view of the detail of sensor in FIG. 3.
Figure 6:
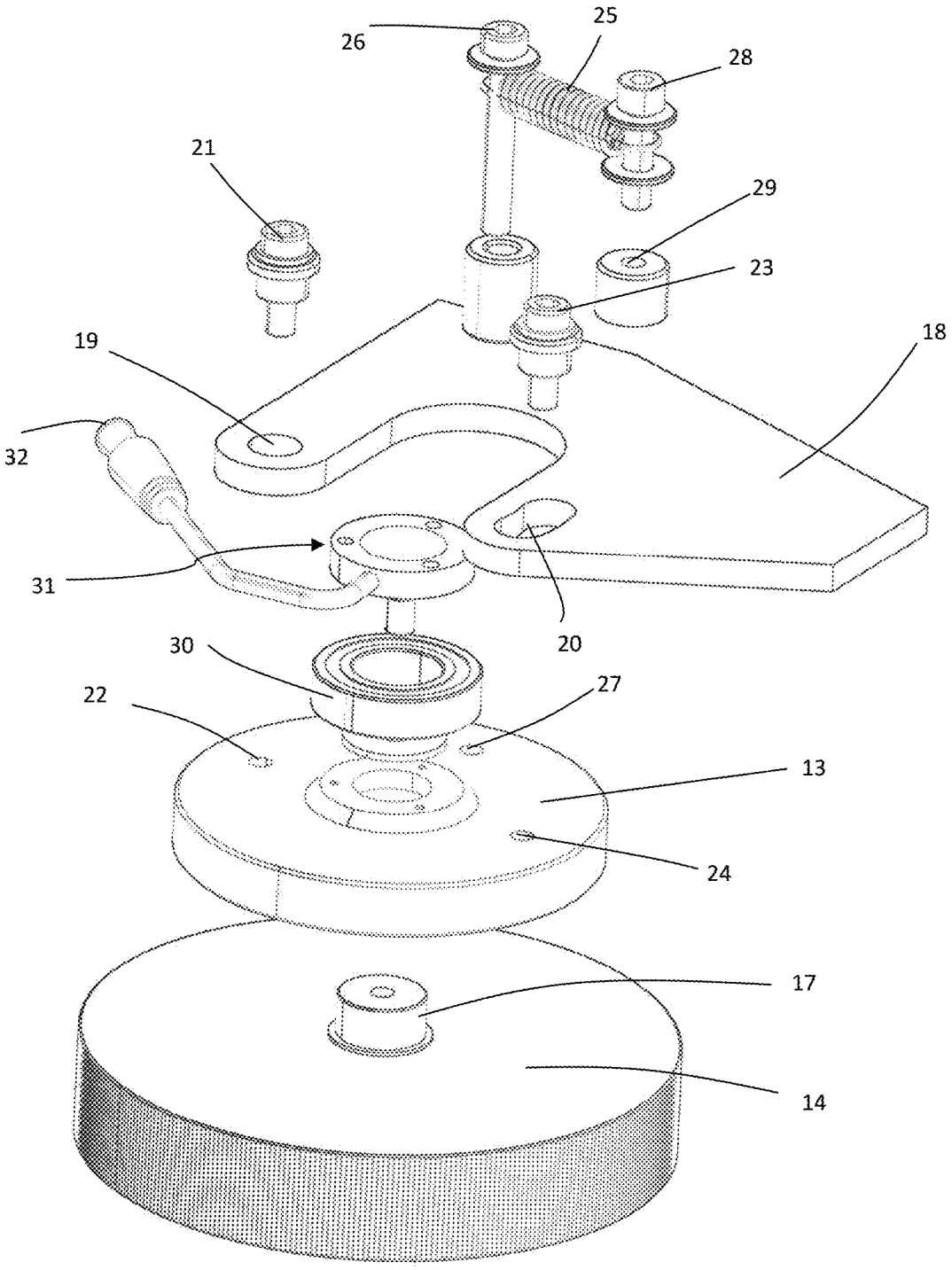
FIG. 6 is an exploded perspective view of the detail of sensor in FIG. 3.

According to the described arrangement, the preloaded coil spring 25 has a tendency, by tensilely acting, to bias the stationary body 13, and consequently the wheel 14, towards the left in FIG. 4, where the connection of this latter to the tubular body 11 is provided. Therefore, in case of oscillations/deformations of the column 2 towards the left in FIG. 4, the wheel 14 will have a tendency of following these oscillations/deformations while, in case of oscillations/deformations of the column 2 towards the right in FIG. 4, the wheel 14 will be pressed against the tubular body 11 by a greater force due to the deformation of the coil spring 25.

A person skilled in the art in order to meet specific contingent needs, can introduce several additions, modifications, or substitutions of elements with other operatively equivalent ones to the described embodiments without falling out of the scope of the attached claims.

What is claimed is:

1. A limited rotation slewing ring crane comprising:

a pedestal;

a column rotatively coupled about a first rotation axis to the pedestal by a slewing ring rotative coupling;

means for limiting the relative rotation of the column with respect to the pedestal; and a rotation sensor adapted to measure a rotation angle of the column with respect to the pedestal;

wherein said rotation sensor comprises:

a tubular body, axially extending from the base of the column, rotatively integral with the same and axially protruding from the same towards the inside of the pedestal;

a stationary body connected to the pedestal and a wheel, rotatable with respect to the stationary body about a second rotation axis, which is meshed by the tubular body, wherein the second rotation axis of the wheel with respect to the stationary body is offset with respect to the first rotation axis of the column with respect to the pedestal;

means for sensing the angular position of the wheel with respect to the stationary body; and a plurality of hydraulic tubes and/or electric cables passing through said tubular body.

2. The limited rotation slewing ring crane according to claim 1, wherein the stationary body is connected to the pedestal so that it can oscillate between two end positions, with respect to it about an oscillation axis offset with respect to the second rotation axis of the wheel with respect to the stationary body, the rotation sensor further comprising elastic means such to bias the stationary body towards a position so that the wheel is biased against the tubular body.

3. The limited rotation slewing ring crane according to claim 2, wherein said oscillation axis of the stationary body with respect to the pedestal is parallel to the second rotation axis of the wheel with respect to the stationary body.

4. The limited rotation slewing ring crane according to claim 2, wherein the pedestal comprises a connecting plate having a first hole and a crescent-shaped slot, the stationary body being connected to the plate by a first screw crossing the first hole of the plate and fixed in a first connecting seat of the stationary body and by a second screw crossing the crescent-shaped slot of the plate, and fixed in a second connecting seat of the stationary body.

5. The limited rotation slewing ring crane according to claim 4, wherein said elastic means comprise a coil spring fixed, at a first end thereof, by a third screw in a third seat of the stationary body, and fixed, at a second end thereof, by a fourth screw in a fourth seat of the connecting plate.

6. The limited rotation slewing ring crane according to claim 1, wherein the second rotation axis of the wheel with respect to the stationary body is parallel to the first rotation axis of the column with respect to the pedestal.

7. The limited rotation slewing ring crane according to claim 1, wherein the tubular body comprises an auxiliary crown concentric with it, made of a deformable material, wherein said auxiliary crown meshes the wheel.

8. The limited rotation slewing ring crane according to claim 7, wherein the wheel comprises circumferentially disposed raised elements such to deform the auxiliary crown of the tubular body.

9. The limited rotation slewing ring crane according to claim 7, wherein the wheel comprises a circumferential crown made of a deformable material, in contact with the auxiliary crown of the tubular body.

10. The limited rotation slewing ring crane according to claim 7, wherein said auxiliary crown of the tubular body and/or said circumferential crown of the wheel are made of an elastomeric material.

11. The limited rotation slewing ring crane according to claim 1, wherein the sensing means comprise a magnet associated to the wheel and a sensing probe associated to the stationary body, configured to sense the angular position of the magnet with respect to the probe.

* * * * *